United States Patent [19]

Kouse et al.

[11] 4,178,649

[45] Dec. 18, 1979

[54] TUBE CLEANING DEVICE

[75] Inventors: Charles H. Kouse; James L. Herzog, both of Springfield, Ohio

[73] Assignee: Carrier Corporation, Syracuse, N.Y.

[21] Appl. No.: 900,837

[22] Filed: Apr. 28, 1978

[51] Int. Cl.[2] ..... B08B 9/04

[52] U.S. Cl. ..... 15/104.06 R

[58] Field of Search ..... 15/104.05, 104.06 R, 15/104.06 A, 104.16, 104.2, 3.5; 166/170

[56] References Cited

U.S. PATENT DOCUMENTS

| | | | |
|---|---|---|---|
| 2,201,680 | 5/1940 | Haynes | 15/104.06 R |
| 3,003,560 | 10/1961 | Corley, Jr. et al. | 166/170 X |
| 3,007,525 | 11/1961 | Orr | 166/170 |
| 3,939,519 | 2/1976 | Muirhead | 15/104.06 R |

*Primary Examiner*—Edward L. Roberts

*Attorney, Agent, or Firm*—J. Raymond Curtin; John S. Sensny

[57] ABSTRACT

A tube cleaning device comprising a body extending both in a longitudinal direction and a transverse direction and defining an opening in a first end and a longitudinally extending recess in communication with the opening, wherein the perimeter of the recess is larger than the perimeter of the opening. The cleaning device further comprises a neck extending longitudinally from a second end of the body and having a perimeter less than the perimeter of the opening, a plug extending longitudinally from the neck and having a perimeter larger than the perimeter of the opening but smaller than the perimeter of the recess, and a scraper extending from a side of the body.

8 Claims, 5 Drawing Figures

TUBE CLEANING DEVICE

BACKGROUND OF THE INVENTION

This invention relates to a device for cleaning the interior of tubes, and more specifically to a device particularly well suited for cleaning the interior of curved tubes.

Over a period of time, the insides of fluid conducting tubes develop scales, rust, or other deposits. Accordingly, the interiors of the tubes must be periodically cleaned. This can be done by utilizing a plurality of cleaning devices which can be sequentially joined together to form a chain. The chain is pulled or pushed through a tube, and the cleaning devices have a scraper member which scrapes against the inside of the tube as the chain passes through the tube, cleaning deposits off of the inside surface of the tube. Preferably, the chain is flexible, permitting the chain to pass through a curved tube as well as a straight tube. Prior art devices of this nature are disclosed in U.S. Pat. Nos. 1,612,842; 1,912,137; 2,246,421; 2,544,290; and 3,778,859. These patents appear to show the prior art that is most relevant to the present invention.

As a review of this art will indicate, connecting and unconnecting prior art cleaning devices requires a significant amount of time and often requires external hardware or tools. In order to minimize labor and related expenses in forming the chain and in replacing individual cleaning devices, it is desirable that the cleaning devices be connected and unconnected as quickly as possible in a manner involving a minimum number of parts and tools. The cleaning devices of the present invention can be easily and quickly joined together in a way that requires only a minimum of skill and labor and no external hardware or parts. Consequently, it is believed that the present invention patentably distinguishes the prior art.

SUMMARY OF THE INVENTION

In view of the above, an object of the present invention is to improve tube cleaning devices.

Another object of the invention is to provide tube cleaning devices which can quickly and easily be connected to and unconnected from each other in a manner requiring no external hardware or tools.

A further object of the present invention is the provision of a simple, reliable, and inexpensive flexible cleaning chain for cleaning the interior of fluid conducting tubes.

These and other objectives are attained with a tube cleaning device comprising a body extending in both a longitudinal direction and a transverse direction and defining an opening in a first end and a longitudinally extending recess in communication with the opening, wherein the perimeter of the recess is larger than the perimeter of the opening. The cleaning device further comprises a neck extending longitudinally from a second end of the body and having a perimeter less than the perimeter of the opening, a plug extending longitudinally from the neck and having a perimeter larger than the perimeter of the opening but smaller than the perimeter of the recess, and a scraper extending from a side of the body.

Further benefits and advantages of the invention will become apparent from a consideration of the following description and drawings.

DETAILED DESCRIPTION OF THE PREFERRED EMBODIMENT

Figure 2:
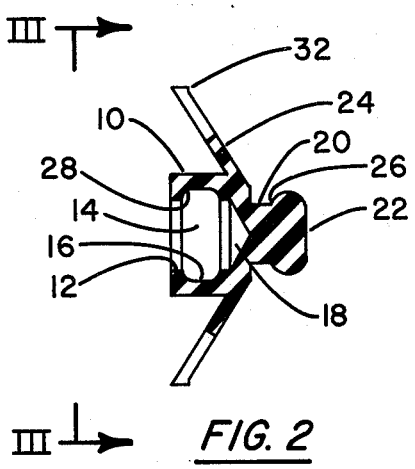
FIG. 2 is a side sectional view of the cleaning device shown in FIG. 1 taken along line II—II of FIG. 1.
Figure 1:
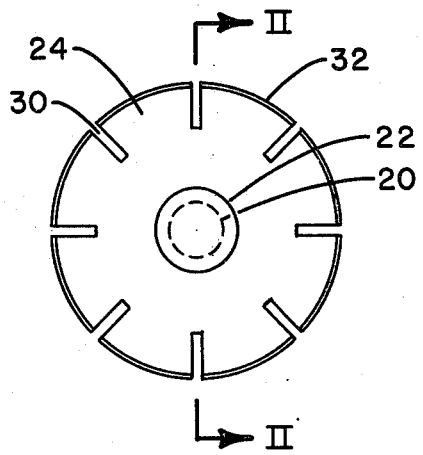
FIG. 1 is a front view of the cleaning device of the present invention.
Figure 3:
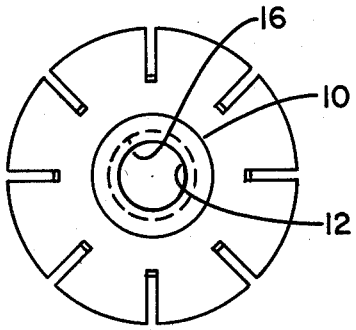
FIG. 3 is a rear view of the cleaning device shown in FIGS. 1 and 2 taken along line III—III of FIG. 2.

Referring to the drawings, there is shown the cleaning device of the present invention. The device includes a centrally located body 10 extending both in a longitudinal direction and a transverse direction. The body 10 defines an opening 12 in an end thereof, and a longitudinally extending recess 14 that is in communication with the opening 12. In a preferred embodiment, the opening 12 has a circular shape, and the recess 14 is comprised of a cylindrically shaped void 16 and a conically shaped void 18. In addition, it is preferred that the back opening 12, the cylindrically shaped void 16, and the conically shaped void 18 all be concentric with respect to each other.

The cleaning device also comprises a neck 20 extending longitudinally from a second end of the body 10, a plug 22 extending longitudinally from the neck, and a scraper 24 extending from the side of the body. In the preferred mode illustrated in the drawings, both the neck 20 and the plug 22 are cylindrically shaped, and these two members are concentric with each other and with the back opening 12, the cylindrically shaped void 16, and the conically shaped void 18.

The perimeter of the back opening 12 is less than the perimeter of the cylindrically shaped void 16, and the perimeter of the neck 20 is less than the perimeter of the back opening 12 and less than the perimeter of the cylindrically shaped void 16. The perimeter of the plug 22 is greater than the perimeter of the back opening 12 but less than the perimeter of the cylindrically shaped void 16. Moreover, the length of the neck 20 is greater than the length of the front opening 12, and the length of the plug 22 is less than the length of the cylindrically shaped void 16.

With these dimensions, the plug 22 of a first cleaning device can be pushed through the back opening 12 and into the recess 14 of a second cleaning device, thereby joining the two devices together. Since the perimeter of the plug 22 is greater than the perimeter of the opening 12, once joined, the two cleaning devices are held together by abutting contact between a flange 26 of the plug 22 of the first device, formed by the portion of the plug extending transversely beyond the neck 20 of the device, and a flange 28 of the second device, formed by the portion of the body 10 of that device defining the opening 12 of the second device. Thus, the cleaning devices of the present invention can be joined to each other very quickly and simply and in a manner not requiring any tools or additional parts. To disconnect the cleaning devices, the devices are simply manually pulled apart, forcing the plug 22 of the first device through the opening 12 of the second device. To facilitate connecting and disconnecting the cleaning devices, the perimeter of the plug 22 is only slightly larger than the perimeter of the opening 12; and the entire cleaning device, including the plug and the body 10, is formed from resilient material.

Figure 4:
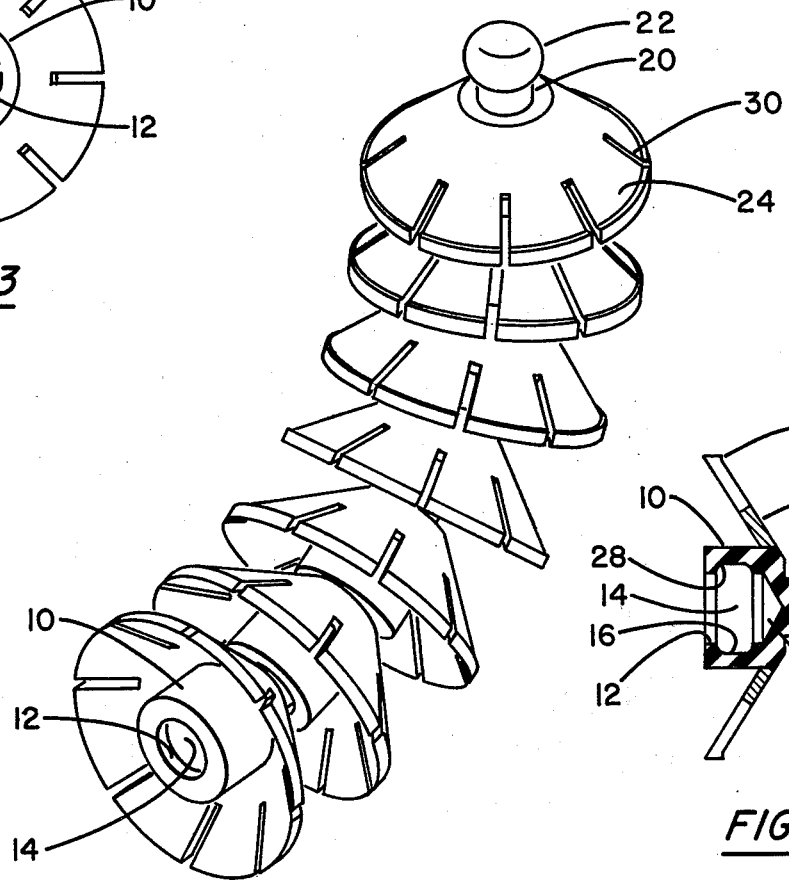
FIG. 4 is a front perspective view of a chain comprised of a plurality of the cleaning device shown in FIGS. 1 through 3.
Figure 5:
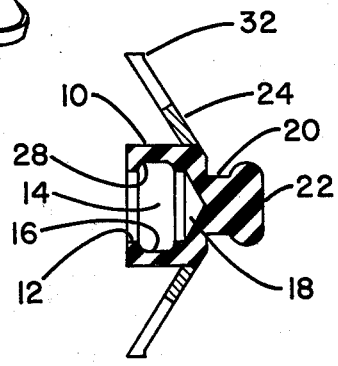
FIG. 5 is a side sectional view of an alternate embodiment of the cleaning device of the present invention.

FIG. 4 shows a plurality of the cleaning device of the present invention joined together to form a chain. A chain of any length can be formed by connecting together as many cleaning devices as are needed. The plug 22 is smaller than the recess 14, so the plug of one cleaning device can move within the recess of an adjacent cleaning device, allowing adjacent cleaning devices to bend relative to each other. The chain can be pulled or pushed through a curved tube, following the contour of the tube and bending where the tube curves. As the cleaning devices travel through the tube, the outer portions of the scrapers 24 scrape against the inside surface of the tube, rubbing deposits off of that surface. Thus, the inside of the tube is cleaned. In a preferred mode, the scraper portion 24 of the cleaning device includes a plurality of slots 30 which extend from the outside circumference of the scraper toward the body 10 of the cleaning device and a peripheral lip 32. The slots 30 increase the flexibility of the scraper 24, and allow the scraper to bend or deform without breaking. The lip 32 increases the angle of incidence between the scraper 24 and deposits on the inside surface of the tube, facilitating scraping those deposits off of the tube surface. Although preferably the entire cleaning device, including the body 10 and the scraper 24, is an integral unit, alternately, as shown in FIG. 5, the scraper can be separable from the body. A separable scraper 24 permits different scrapers to be used with the same body 10, depending on the size and type of tube which is to be cleaned and the type of deposits expected to be encountered.

While it is apparent that the invention herein disclosed is well calculated to fulfill the object above stated, it will be appreciated that numerous modifications and embodiment may be devised by those skilled in the art, and it is intended that the appending claims cover all such modifications and embodiments as fall within the true spirit and scope of the present invention.

What is claimed is:

1. A tube cleaning device comprising:

a body extending both in a longitudinal direction and a transverse direction and defining an opening in a first end thereof and a longitudinally extending recess in communication with the opening, wherein the perimeter of the recess is larger than the perimeter of the opening;

a neck extending longitudinally from a second end of the body and having a perimeter less than the perimeter of the opening;

a plug extending longitudinally from the neck and having a perimeter larger than the perimeter of the opening but smaller than the perimeter of the recess; and a scraper extending from a side of the body toward the trailing side of the cleaning device at an acute angle to the longitudinal axis thereof, wherein the surface of the scraper facing the leading side of the cleaning device defines a substantially transverse peripheral lip for facilitating cleaning the tube.

2. The tube cleaning device of claim 1 wherein:

the length of the neck is greater than the length of the opening; and the length of the plug is less than the length of the recess.

3. The tube cleaning device of claim 2 wherein:

the opening is generally circular in shape;

the recess includes a generally cylindrically shaped void that is substantially concentric with the opening;

the neck is generally cylindrically shaped and is substantially concentric with the cylindrically shaped void; and the plug is generally cylindrically shaped and is substantially concentric with the neck.

4. The tube cleaning device of claim 3 wherein the recess further includes a conically shaped void extending longitudinally from and substantially concentric with the cylindrically shaped void.

5. The tube cleaning device of claim 4 wherein the scraper further includes a plurality of slots for increasing the flexibility of the scraper.

6. The tube cleaning device of claim 5 wherein the scraper is integral with the body.

7. The tube cleaning device of claim 5 wherein the scraper is separable from the body.

8. A flexible chain for cleaning the inside of a tube, comprising a plurality of individual cleaning devices, wherein each cleaning device includes:

a body defining an opening in a first end thereof and a longitudinally extending recess in communication with the opening;

a neck extending longitudinally from a second end of the body;

a plug extending longitudinally from the neck; and a scraper extending from a side of the body toward the trailing side of the cleaning device at an acute angle to the longitudinal axis thereof, wherein the surface of the scraper facing the leading side of the cleaning device defines a substantially transverse peripheral lip for facilitating cleaning the tube; and wherein:

the perimeter of the recess is larger than the perimeter of the opening;

the perimeter of the neck is smaller than the perimeter of the opening so that the neck of a first cleaning device can pass through the opening of a second cleaning device; and the plug is smaller than the recess so that the plug of the first cleaning device is movable within the recess of the second cleaning device, and the perimeter of the plug is greater than the perimeter of the opening so that the plug of the first cleaning device is not freely movable through the opening of the second cleaning device.

* * * * *